US009291133B2

(12) United States Patent
Pickell et al.

(10) Patent No.: US 9,291,133 B2
(45) Date of Patent: Mar. 22, 2016

(54) SHAFT ARRANGEMENT FOR AN AXIAL PISTON PUMP ASSEMBLY

(75) Inventors: Michael E. Pickell, Washington, IL (US); Bryan E. Nelson, Lacon, IL (US); Satyasai C. Avasarala, Pontiac, IL (US); David E. Hackett, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 1097 days.

(21) Appl. No.: 13/330,736

(22) Filed: Dec. 20, 2011

(65) Prior Publication Data

US 2013/0152779 A1 Jun. 20, 2013

(51) Int. Cl.

| | |
|---|---|
| ***F04B 9/04*** | (2006.01) |
| ***F02M 39/02*** | (2006.01) |
| ***F04B 1/04*** | (2006.01) |
| ***F04B 53/00*** | (2006.01) |

(52) U.S. Cl.

CPC ..... *F02M 39/02* (2013.01); *F04B 1/0413* (2013.01); *F04B 1/0448* (2013.01); *F04B 9/042* (2013.01); *F04B 53/006* (2013.01); *Y10T 29/49236* (2015.01)

(58) Field of Classification Search

CPC ..... F04B 9/042; F04B 1/148; F04B 27/1063; F04B 1/0413; F04B 1/0448; F01L 1/08; F02M 41/02

USPC ..... 92/71; 91/499; 74/60

See application file for complete search history.

(56) References Cited

U.S. PATENT DOCUMENTS

| | | | | |
|---|---|---|---|---|
| 3,357,363 | A | 12/1967 | Raymond | |
| 3,742,883 | A | 7/1973 | Costanzo | |
| 4,010,830 | A | 3/1977 | Logus et al. | |
| 4,231,622 | A | 11/1980 | Paullin | |
| RE30,994 | E | 7/1982 | Shaw | |
| 4,358,000 | A | 11/1982 | Cumming | |
| 4,397,380 | A | 8/1983 | Yew | |
| 4,473,330 | A | 9/1984 | Chalier | |
| 4,655,326 | A | 4/1987 | Osenbaugh | |
| 5,050,710 | A | 9/1991 | Bargfrede | |
| 5,354,181 | A * | 10/1994 | Porel | 417/269 |
| 5,393,205 | A | 2/1995 | Fujii et al. | |
| 5,671,648 | A | 9/1997 | Dern | |
| 6,017,097 | A | 1/2000 | Weir, III | |

(Continued)

FOREIGN PATENT DOCUMENTS

| | | | |
|---|---|---|---|
| CN | 201196207 | Y * | 2/2009 |
| GB | 2169361 | | 7/1986 |
| JP | 2011021405 | | 2/2011 |

*Primary Examiner* — Nathaniel Wiehe

*Assistant Examiner* — Abiy Teka

(74) *Attorney, Agent, or Firm* — Daniel Spillman; Jeff A. Greene

(57) ABSTRACT

A shaft arrangement for an axial piston pump assembly to couple to a rotatable member such as a gear therewith. A shaft extends at least partially through a housing chamber of the pump about a longitudinal axis. Reciprocating pistons are disposed within the chamber radially about the shaft. A cam unit is fitted over the shaft and provides an angled camming surface to engage the pistons. Bearing assemblies are fitted over the cam unit. An adapter can be fitted over the proximal end of the cam unit. The adapter has a distal surface which may abut the bearing assembly and be axially spaced from the cam unit, and an outer radial surface to engage the rotatable member. A clamping device provides a desired clamp load path between the rotatable member, the adapter, the cam unit, the bearing assemblies and the shaft.

18 Claims, 5 Drawing Sheets

(56) References Cited

U.S. PATENT DOCUMENTS

| | | | | |
|---|---|---|---|---|
| 6,035,828 | A | 3/2000 | Anderson et al. | |
| 6,264,009 | B1 | 7/2001 | Johnson | |
| 6,305,515 | B1 | 10/2001 | Heidenreich et al. | |
| 6,405,707 | B1 | 6/2002 | Feucht | |
| 6,561,771 | B2 | 5/2003 | Keyster et al. | |
| 6,726,553 | B2 | 4/2004 | Tiede et al. | |
| 6,893,228 | B2 | 5/2005 | Nelson | |
| 6,896,491 | B2 | 5/2005 | Trubnikov et al. | |
| 7,258,208 | B1 | 8/2007 | Dennis et al. | |
| 7,506,730 | B2 | 3/2009 | Strandberg et al. | |
| 7,510,064 | B2 | 3/2009 | Graves | |
| 8,215,430 | B2 * | 7/2012 | Thomson et al. | 180/65.51 |
| 2003/0111059 | A1 * | 6/2003 | Hu et al. | 123/497 |
| 2004/0109626 | A1 * | 6/2004 | Trubnikov et al. | 384/559 |

* cited by examiner

SHAFT ARRANGEMENT FOR AN AXIAL PISTON PUMP ASSEMBLY

TECHNICAL FIELD

The present disclosure relates to pump assemblies and, more particularly, to a shaft arrangement for axial piston pump assemblies to withstand axial and radial loads.

BACKGROUND

Axial piston pumps are known to be used in hydraulically-actuated fuel injection systems. One exemplary axial piston pump is a hydraulic electronic unit injector (HEUI) pump assembly. The efficient operation of such pumps is significant to the overall operation of the engine. Moreover, the ability of such pumps to operate free of maintenance is important to reduce downtime of the system. While efficient operation is an important design criteria, issues such as weight, size, cost, and ease of assembly influence the overall design of such pump.

U.S. Pat. No. 6,035,828 to Anderson et al., which is incorporated herein by reference in its entirety, describes a fixed displacement, variable delivery axial piston pump for a hydraulically-actuated fuel injection system. In the system, a high pressure common rail supplies hydraulic fluid to a plurality of hydraulically-actuated fuel injectors mounted in a diesel engine. The hydraulic fluid received in the common rail is pressurized by the fixed displacement axial piston pump that is driven directly by the engine. The pump includes a plurality of pistons disposed in parallel about the central longitudinal axis of the pump. An angled camming surface or swash plate is fixed to the drive shaft and is biased against a proximal end of the pistons. Low pressure actuation fluid (e.g., lubricating oil) flows through windows in the radial outer surface of a swash plate and travels radially inward to the pistons in order to be pressurized. Reciprocation of the pistons is achieved by the rotation of the swash plate. Displacement of the pump is varied by a control valve that selectively varies the amount of pressurized fluid supplied to the pump outlet during the discharge stroke of each piston. FIG. 2 of Anderson et al. illustrates two opposed tapered roller bearing arrangements for receiving axial forces created during pump operation.

In another example, U.S. Pat. No. 6,896,491 to Trubnikov et al., which is incorporated herein by reference in its entirety, describes a fixed displacement, variable delivery axial piston pump for a hydraulically-actuated fuel injection system. Here, the fixed angle swash plate can include a cylindrical elongated portion. The elongated portion can be press-fitted over the center pump drive shaft for a secure fit. The end of the elongated portion can be a tapered end. The tapered end can frictionally engage a conical recess of gear drive mechanism such that the rotation of the center pump drive shaft is directly proportionally to the drive shaft of the engine.

While the aforementioned axial piston pump assemblies operate adequately, there is a need for an improved shaft arrangement to sufficiently withstand the rotational gear loads and the axial thrust loads. The present application is directed at overcoming one or more of the problems associated with axial piston pump assemblies of the prior art.

SUMMARY OF THE INVENTION

In one embodiment, a pump assembly is described herein for coupling to a rotatable member, such as, e.g., a gear to couple to an external drive shaft. A center shaft can extend at least partially through a housing chamber of a pump housing and is rotatable about a longitudinal axis. A plurality of reciprocating pistons can be disposed within the housing chamber radially about the center shaft. A cam unit can include a cam body and a central bore extending through the cam body about the longitudinal axis to receive a portion of the center shaft. A distal end of the cam unit can have a camming surface that extends radially outward from the cam body to engage each of the reciprocating pistons. One or more bearing assemblies can be disposed along the cam body between the distal and proximal ends of the cam unit. An adapter has a central opening extending therethrough about the longitudinal axis to engage the proximal end of the cam unit. A distally facing surface of the adapter can abut the most proximate bearing assembly. The distally facing surface may be spaced from a proximally facing surface of a shoulder portion of the cam unit. An outer radial surface of the adapter can engage the rotatable member. A clamping device is insertable through the central opening of the adapter and the central bore of the cam unit to fixedly attach to the center shaft.

In another embodiment, a method of connecting a rotatable member such as, e.g., a gear, to a pump assembly. An adapter can be coupled to the rotatable member via a conical friction interface. A bearing assembly can be coupled to the adapter such that a distal surface of the adapter is in an abutting relationship with the bearing assembly. The adapter can be fitted over a proximal end of a cam unit such that a gap is formed between the distal surface of the adapter and a confronting proximal surface of the cam unit. A distal end of the cam unit can include an angled camming surface in engagement with a plurality of pistons contained within the pump assembly.

DETAILED DESCRIPTION

Reference will now be made in detail to the exemplary embodiments of the invention, examples of which are illustrated in the accompanying drawings. Wherever possible, the same reference numbers will be used throughout the drawings to refer to the same or like parts.

Figure 1:
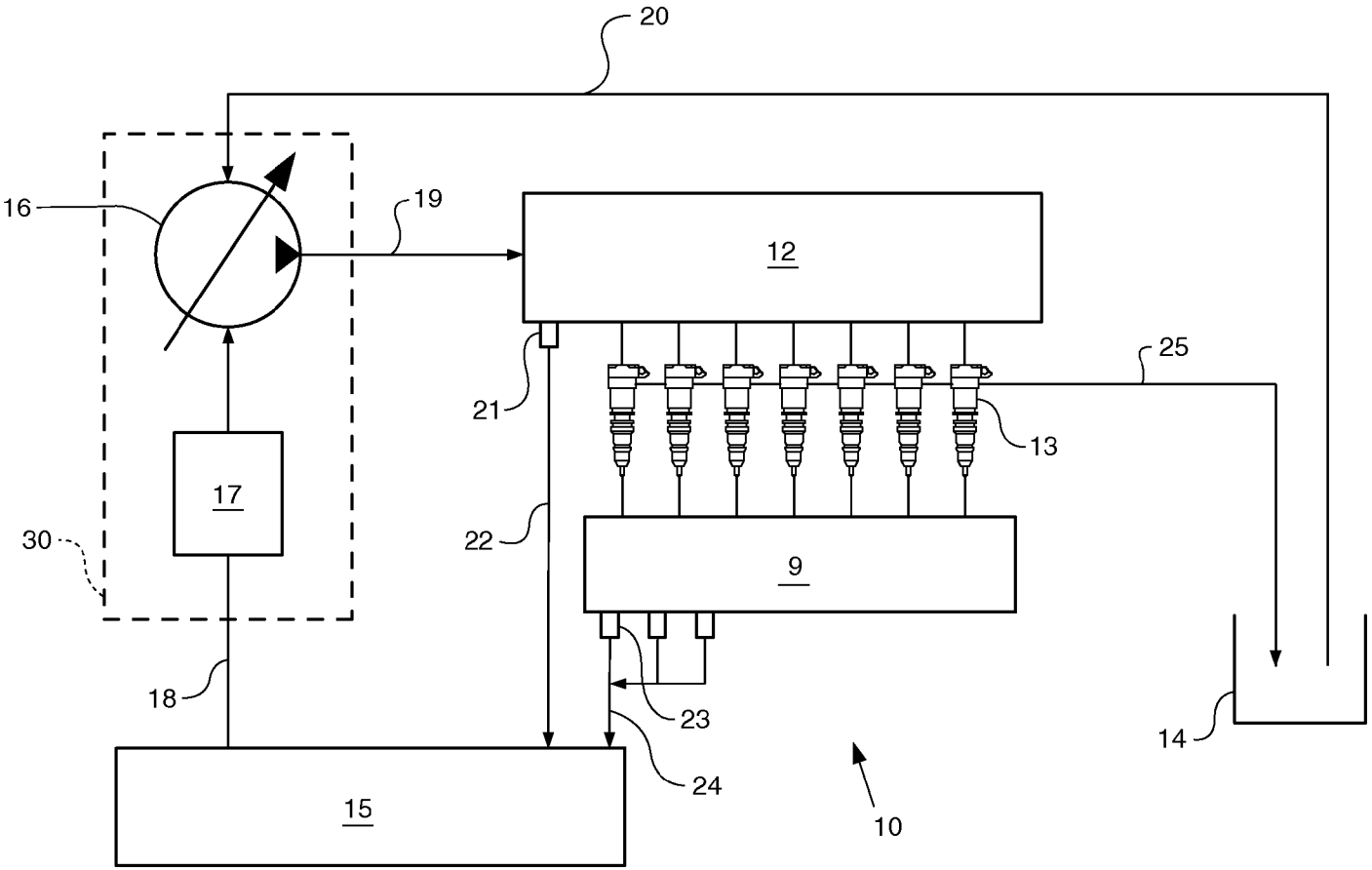
FIG. 1 is a schematic illustration of a hydraulically actuated-system.

Referring now to FIG. 1, a hydraulically actuated-system 10 is attached to an internal combustion engine 9. The hydraulic system 10 can include a high pressure common fluid rail 12 that can supply high pressure actuation fluid to a plurality of hydraulically-actuated devices, such as hydraulically-actuated fuel injectors 13. Those skilled in the art will appreciate that other hydraulically-actuated devices, such as actuators for gas exchange valves for exhaust brakes, could be substituted for the fuel injectors 13 illustrated in the example embodiment. The common rail 12 is pressurized by a variable delivery fixed displacement pump 16 via a high pressure supply conduit 19. One example of such pump is a HEUI pump. The pump 16 draws actuation fluid along a low pressure supply conduit 20 from a source of a low pressure fluid 14, which can be, e.g., the engine's lubricating oil sump. Although other available liquids could be used, the system utilizes engine lubricating oil as its hydraulic medium. After the high pressure fluid does work in the individual fuel injectors 13, the actuating fluid is returned to the source of the low pressure fluid 14, such as the sump, via a drain passage 25.

As is well known in the art, the desired pressure in the common rail 12 is generally a function of the engine's operating condition. For instance, at high speeds and loads the rail pressure is generally desired to be significantly higher than the desired rail pressure when the engine is operating at an idle condition. One or more engine operating condition sensors 23 may be coupled to the engine at various locations to provide an electronic control module 15 with data through communication lines 24. Sensor(s) 23 may detect one or more engine parameters including, for example, engine speed, engine crankshaft position, engine coolant temperature, engine exhaust back pressure, air intake manifold pressure, throttle position, or any combination thereof. In addition, a pressure sensor 21 may provide the electronic control module 15 with a measure of the fluid pressure in the high pressure common rail 12 via a communication line 22. The electronic control module 15 may be designed to compare a desired rail pressure, which is a function of the engine operating condition, with the actual rail pressure as measured by the pressure sensor 21.

If the desired and measured rail pressures are different, the electronic control module 15 may command movement of a fluid delivery control assembly 17, such as a control valve, via a communication line 18. The position of the control assembly 17 facilitates in determining the amount of working fluid that leaves the pump 16 via the high pressure supply line 19 and goes to the common rail 12. Both of the control assembly 17 and the pump 16 may be contained in a single stationary pump housing 30. Further, the electronic control module 15 may be coupled to each fuel injector 13 via a communication line (not shown) to provide control signals to the working fluid valves of each fuel injector 13 to control the timing and duration of each fuel injection.

Figure 2:
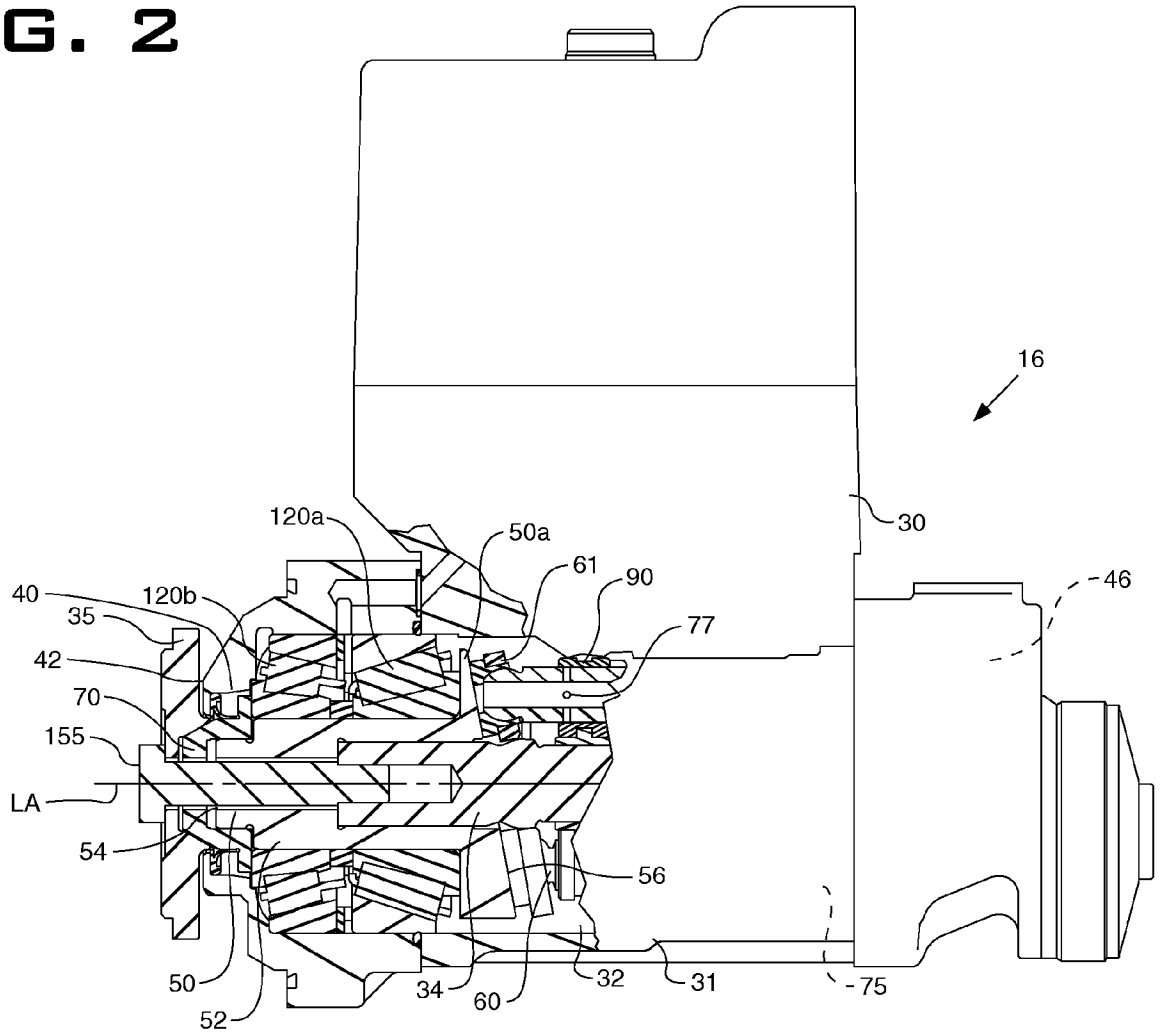
FIG. 2 is a cross-sectional view of one example of a pump of the system of FIG. 1.
Figure 3:
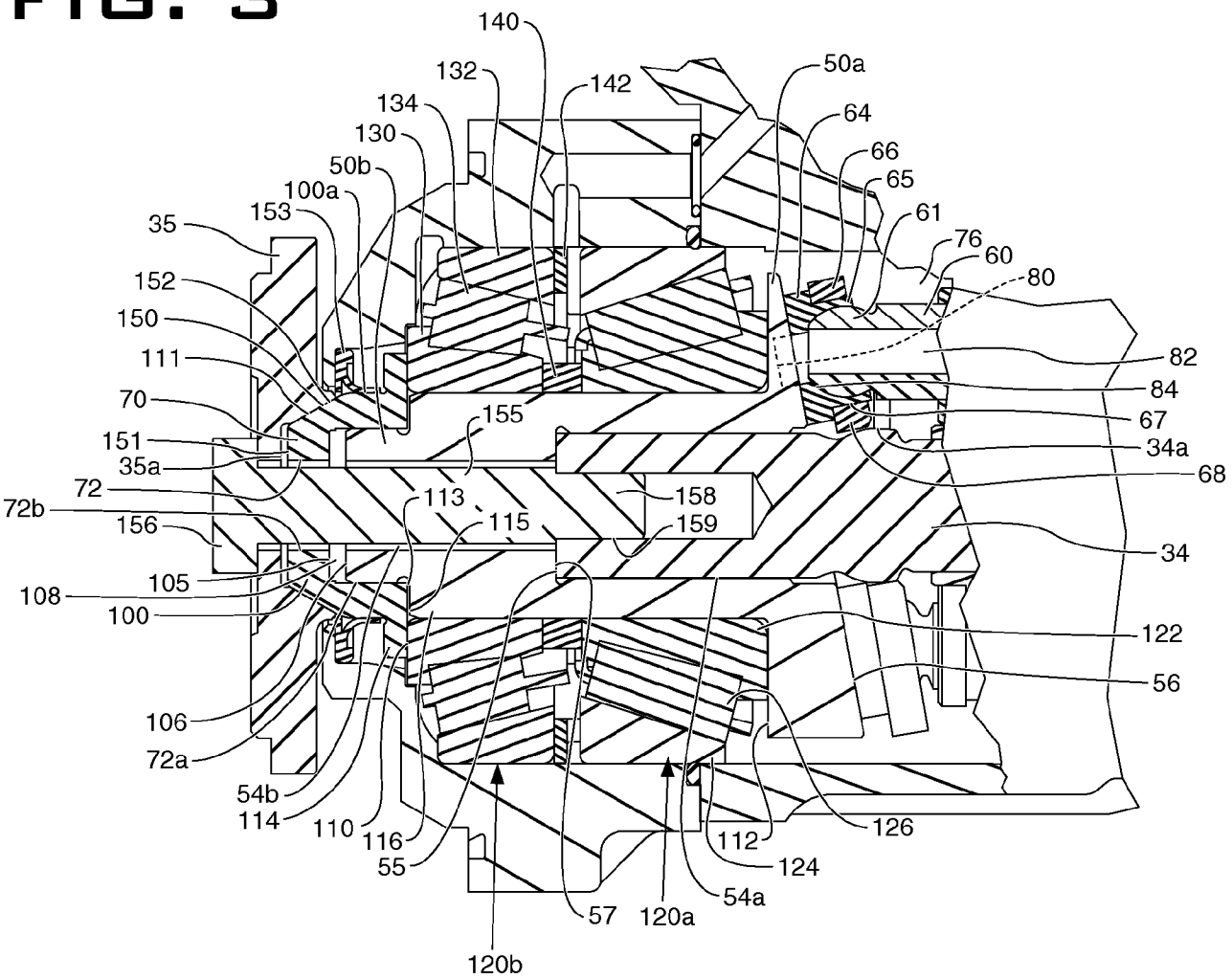
FIG. 3 is an enlarged cross-sectional view of a proximal end of the pump of FIG. 2, depicting one example of a shaft arrangement.

Referring now to FIGS. 2-3, the various features of the pump 16 can be contained within a housing chamber 32 of the pump housing 30. The pump 16 includes a rotating center shaft 34 about a longitudinal axis LA that is coupled indirectly to the output of the engine 9, such that the rotation rate of the shaft 34 is directly proportional to the engine drive shaft of the engine 9, typically through a gear assembly 35. The gear assembly 35 can include one or more gears coupled between the center shaft 34 of the pump and the engine drive shaft. The gear assembly 35 can be disposed external to the pump housing 30.

The pump housing 30 may also include a shaft opening 40 at its proximal gear end 42 and an outlet passage (not shown) at its distal end 46. The shaft opening 40 may communicate with the housing chamber 32 and receive a portion or an extension of the center shaft 34 therethrough. The outlet passage may communicate with the high pressure supply conduit 19 (FIG. 1) and with the housing chamber 32, and may be aligned with a central outlet.

A cam unit 50 can be coupled to the center shaft 34 and is operable to cause a plurality of pistons 60 to reciprocate with relative movement between the cam unit and the pistons. The cam unit 50 can include a cam body 52 and a central bore 54 extending therethrough about the longitudinal axis LA. The central bore 54 is sized to receive a portion of the center shaft 34. The central bore 54 may include a counterbore arrangement. For example, in FIG. 3, the central bore 54 may have an enlarged distal portion 54A that is sized to receive the respective center shaft portion. A proximal portion 54B of the central bore 54 can be sized smaller relative to the distal portion 54A to form an internal shoulder 55 at the transition between the differently sized portions 54A, 54B of the central bore. To this end, the proximal end 57 of the center shaft 34 can be in an abutting relationship with the internal shoulder 55 when under operation.

The cam unit 50 can include a camming surface 56 at its first, distal end 50A to engage with each of the pistons 60. The camming surface 56 can extend radially outward relative to a cylindrical portion of the cam body, and may be positioned about the distal portion 54A of the central bore 54. The camming surface 56 may be shaped to have a fixed angle relative to the longitudinal axis LA. Relative rotation between the camming surface 56 of the cam unit 50 and the pistons 60 can cause the pistons 60 to reciprocate from left to right (when viewing the pistons as illustrated in FIG. 2).

In FIG. 3, a second, proximal end 50B of the cam unit 50 can be coupled to a rotatable member adapter such as a gear adapter 70. It can be appreciated by those skilled in the art that, instead of a gear, other rotatable members can be used such as a wheel, cam, or hub to be driven by other components such as belt-driven machines or reciprocating machines, although the description herein will focus on gear mechanisms and adapters used therewith. In one example, the proximal end 50B of the cam unit 50 can be shaped and sized to have a reduced cross-sectional area relative to an intermediate cam body for insertion within a central opening 72 formed in the gear adapter 70. It is recognized that the gear adapter 70 and the cam unit 50 can be coupled to one another by other mechanisms such as, e.g., a spline, an interference fit, welding, soldering, braiding, or the like.

Referring back to FIG. 2, the pistons 60 can be disposed within a barrel 31 of the pump housing 30 and radially about the center shaft 34 that is about the longitudinal axis LA. Each of the pistons 60 may be positioned relative to the longitudinal axis LA at a fixed distance or at a variable distance. In one example, each of the pistons 60 is positioned in parallel with another and to the longitudinal axis LA. The pistons 60 are operable to be continuously urged toward the camming surface 56 by individual return springs (not shown). The return springs can be disposed internally within the piston 60.

In one example, the pistons 60 can engage the camming surface 56 via a coupling configuration to allow for angular movement between the piston 60 and the camming surface 56, but not relative axial movement between the piston and the camming surface. In one example, the axial engaging end 61 of the pistons 60 may be coupled to a piston shoe 64, as shown in FIG. 3. The proximal end 61 can include a spherically shaped end to be mated with a partially-spherically shaped recess of the shoe 64 to form a ball-socket type coupling. Other coupling configurations may be used so long as the coupling allows for the aforementioned relative angular movement and limited relative axial movement.

A biasing plate 66 can be disposed about the shoes 64 to facilitate maintaining the shoes 64 in contact with the camming surface 56. In one example, the distal end 65 of the shoe 64 may include a recess or groove thereon to receive the biasing plate 66. The biasing plate 66 may include a plurality of shoe holes 67 formed therein spaced, such as, e.g., equally spaced, about a center hole 68 of the biasing plate 66 that is sized for receiving the center shaft 34. The shoe holes 67 of the biasing plate 66 may be configured to allow the shoes 64 to extend therethrough for the length of recess or groove of the shoe 64. The center hole 68 of the biasing plate 66 may be shaped, such as, e.g., to include a rounded portion, for receiving a similarly shaped rounded protrusion 34A of the center shaft 34. The rounded portion of the center hole 68 may be located on a more distal side of the biasing plate 66. A shaft compression spring (not shown) may extend between a portion of the pump housing 30 and a portion of the center shaft 34 to bias the rounded protrusion 34A of the center shaft 34 into the rounded portion of the center hole 68 of the biasing plate 66 and against the biasing plate. This, in turn, can urge the biasing plate 66 and the shoes 64 against the pump housing 30. Any other suitable arrangement of elements may be used to bias the pistons and the shoes against the pump housing.

The biasing force of the return spring 62 of the piston 60 can maintain the coupling between the shoes 64 and the respective proximal ends 61 of the pistons 60 to maintain contact with the camming surface 56 in a conventional manner. Because the camming surface 56 may have a fixed angle relative to the longitudinal axis LA, the pistons 60 can reciprocate through a fixed reciprocation distance with each cycle of rotation of the center shaft 34. Thus, the pump 16 can be thought of as a fixed displacement pump. However, the control valve 17 is configured to determine whether the fluid displaced by the pump 16 is either pushed into a high pressure area 75 (shown in dashed lines) within the pump housing in communication with the high pressure supply conduit 19 past a check valve (not shown) or spilled or leaked back into a low pressure area 76 via a spill port 77. The low pressure area 76 can be a portion of the housing chamber 32 containing a source of low pressure fluid 14. The low pressure fluid, which can be, e.g., the engine's lubricating oil sump, can be in fluid communication with the low pressure supply conduit 20.

In FIG. 3, the cam unit 50 may also include an inlet passage 80 (shown in dashed lines) formed in the distal end 50A of the cam unit 50. The inlet passage 80 is in fluid communication with the low pressure area 76 where the fluid is supplied to the inlet passage 80. The inlet passage 80 may form a fluid opening, such as, e.g., a kidney-shaped opening (not shown), oriented to be in alignment to provide fluid communication with an axial piston bore 82 of the piston 60 through a shoe bore 84 of the shoe 64 at a range of angular positions of the center shaft 34 corresponding to the suction strokes of each piston 60. The inlet passage 80 may be formed in any other suitable manner to allow for the flow of fluid into and out of the axial piston bore 82 during a pumping stroke. When the pistons 60 are undergoing the retracting portion of their stroke due to the action of the return spring 62, low pressure fluid can be drawn into the low pressure area 76 into the pumping chamber 32 within the pump housing 30 past an inlet check valve, if provided.

In FIG. 2, the proportion of fluid displaced by the pistons 60 to the respective high pressure area 75 and low pressure area 76 within the pump housing 30 is determined by the position of individual sleeves 90. The sleeves 90 can be mounted to move along the outer surface of the individual pistons 60. Each sleeve 90 can be connected to move with a sleeve actuator via a lever and idler annulus (not shown). An actuator biasing spring may normally bias the actuator toward the left to a position (i.e., a covered position) in which virtually all the fluid displaced by the individual pistons 60 is pushed past the check valve into a high pressure area and eventually out of the pump housing into the common rail.

The aforesaid connection of elements can provide for movement of the control sleeves 90 to cover or uncover the radial spill ports 77 formed in the pistons 60 based on movement of the sleeve actuator in a proximal or distal direction. To this end, the pressure within the piston bore 82 can only build when the shoe bore 84 is covered by the camming surface 56 and the spill ports 77 are covered by the sleeve 90. Thus, when the sleeve 90 covers the respective spill ports 77, fluid displaced by movement of the piston 90 can be pushed past the check valve, into the high pressure area 75 and eventually out of the outlet to the high pressure common rail 12.

In FIG. 3, the gear adapter 70 has a gear adapter body 100 having the central opening 72 formed therein about the longitudinal axis LA. The central opening 72 is sized to receive the proximal end 50B of the cam unit 50 and may have a counterbore arrangement. In one example, the central opening 72 may include an enlarged distal portion 72A that is sized to receive the proximal end 50B of the cam unit 50. A proximal portion 72B of the central opening 72 can be sized smaller relative to the distal portion 72A to form an internal shoulder 105 at the transition between the differently sized portions 72A, 72B of the central opening 72. In one example, the axial end 106 of the cam unit 50 can be axially spaced from the internal shoulder 105 of the gear adapter 70 such that a gap 108 is formed therebetween as illustrated.

The gear adapter body 100 may include a distal surface 110 to capture one or more bearing assemblies (shown as a pair of bearing assemblies 120A, 120B) between the distal surface 110 and a proximal surface 112 of the distal end 50A of the cam unit 50 disposed opposite to the distally facing camming surface 56. In one example, the pair of surfaces 110, 112 extend substantially perpendicular relative to the longitudinal axis in a confronting relationship with one another.

Figure 4:
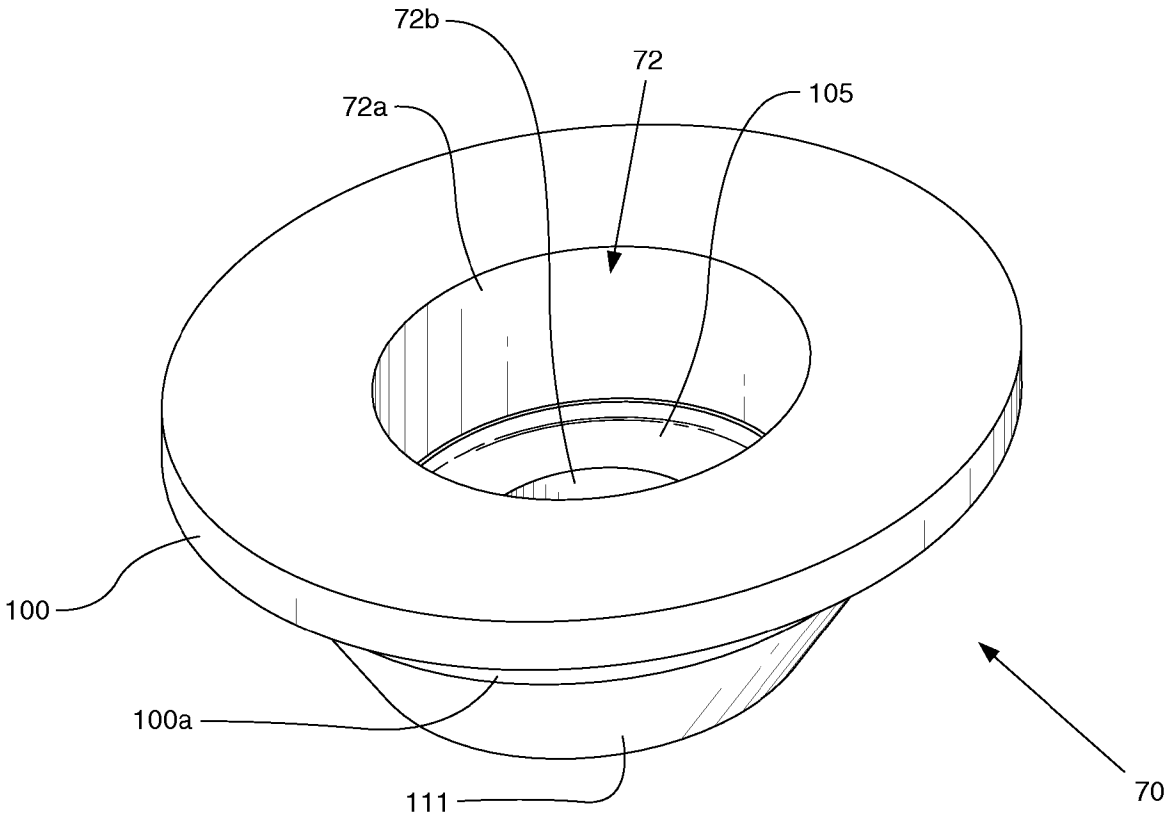
FIG. 4 is a perspective view of one example of an adapter used in one example of a shaft arrangement of the pump of FIG. 2.

With reference to FIGS. 3-4, in one example, the gear adapter body 100 may include a radial flange 114 extending radially outward relative to the main body. The radial flange 114 may extend radially beyond the shoulder portion 116 of the cam unit 50 to abut the bearing assembly closest in proximity. The radial flange 114 can include the distal surface 110. The coupling between the gear adapter 70 and the cam unit 50 can be such a gap 113 exists between the distal surface 110 and a proximally facing confronting surface 115 of the cam unit 50. The gap 113 can facilitate the redirection of the clamp load path for a desired clamp load path between the gear adapter 70 and the bearing assembly, such as the second bearing assembly 120B, rather than directly between the gear adapter 70 and the center shaft 34 via the cam unit 50.

The bearing assembly is coupled within the housing chamber 32 and is operable to support the rotation of the center shaft 34. The illustrated first bearing assembly 120A can be a tapered roller bearing assembly that includes an inner race or cone 122 for engagement with the center shaft 34, an outer race or cup 124 for engagement with the housing 30, and a plurality of rollers 126 disposed between the inner race 122 and the outer race 124. When employed, the second bearing assembly 120B may be similarly configured having an inner race 130, outer race 132, and rollers 134 therebetween. However, each of bearing assemblies may be embodied as any conventional bearing structure, and may be the same or different bearing configurations. A single bearing assembly or more than one bearing assemblies can support the center shaft 34 for rotation within and relative to the pump housing 30.

In one example, the first bearing assembly 120A and the second bearing assembly 120B may be tapered in the opposite direction to form two opposing tapered roller bearing assemblies. In another example, an inner race spacer 140 may be disposed in an abutting relationship between the respective inner races 122, 130 of the first and second bearing assemblies 120A, 120B. The inner race spacer 140 has a ring shape sized to fit over the cam unit 50 and an axial width sized for the desirable separation between the respective inner races. An outer race spacer 142 may be disposed in an abutting relationship between the respective outer races 124, 132 of the first and second bearing assemblies 120A, 120B. The outer race spacer 142 has a ring shape sized to fit over the cam unit 50 spaced radially from the inner race spacer 140 and an axial width sized for the desirable separation between the respective outer races 124, 132. The respective spacers 140, 142 can facilitate preloading of the bearing during assembling, which can be set by the desired separation width between the bearing assemblies. The distal surface 110 of the gear adapter 70 and the proximal surface 112 of the distal end 50A of the cam unit 50 are positioned to restrain any axial movement of the one or more bearing assemblies. The first bearing assembly 120A may be sized to withstand a greater axial load than the second bearing assembly 120B, while the second bearing assembly 120B may be sized to withstand a greater radial load than the first bearing assembly 120A.

A proximal end 111 of the gear adapter body 100 opposite the distal surface 110 can interface with the gear assembly 35. In one example, the outer surface of the proximal end 111 can be chamfered to form a conical surface. A gear of the gear assembly 35 may have a bore 150 formed therein with a tapered recess 152 to form a conical shape having the same degree of taper as the chamfered proximal end 111. The gear adapter 70 can be coupled to such gear such that the axial surface of the proximal end 111 of the adapter is spaced from the internal axial surface 35A of the gear by a gap 151. Consequently with such gap 151, the load path can be directed through the frictional interface between the chamfered proximal end 111 of the gear adapter 70 and the tapered recess 152 of the gear in order to form a gear-drive shaft fuse. Such fuse coupling is configured to allow the gear to spin loose during operation when the torque input is greater than the friction torque at the conical interface.

A shaft seal 153 can be included within the pump housing 30 to inhibit leakage of any internal fluid. The shaft seal 153 can have a ring shape to sealably engage over the cylindrical portion 100A of the gear adapter body 100 to form a substantially sealed surface between the inner surface of the shaft seal 109 and the outer surface of the gear adapter 70. In one example, the shaft seal 153 may be disposed along the cylindrical portion 100A of the gear adapter body 100 between the chamfered proximal end 111 and the radial flange 114 of the gear adapter 70. The shaft seal 153 may be captured between the pump housing and the radial flange of the adapter.

A clamping device 155 can be used to provide a desired clamping load to the shaft arrangement. The clamping device 155 can be fixedly secured to the center shaft 34. In one example, the clamping device 155 includes a proximal end 156 and a distal end 158. The proximal end 156 can be sized larger than the gear bore 150 and can be disposed in an abutting relationship with the gear. The distal end 158 can be elongated to extend from the proximal end 156 about the longitudinal axis LA, and sized to be inserted through the gear bore 150 to be coupled to the center shaft 34. The length of the elongated distal end 158 can be sized to extend through the gear bore 150, the gear adapter central opening 72, and at least partially through the cam unit central bore 54 beyond the internal shoulder 55. The distal end 156 can be securely fixed with the center shaft 34, such as, e.g., the distal end 156 can be threadably engaged with the center shaft 34. In one example, the distal end 156 may have threaded portion along its outer surface for threadable engagement with an internally threaded bore 159 formed in the proximal end 57 of the center shaft 34, as shown in FIG. 3. It is recognized that other attachment mechanisms can be employed between the clamping device 155 and the center shaft 34, such as, e.g., adhesives, welding, soldering, and the like.

The shaft arrangement may be assembled as described in the following. It is recognized that the various components may be assembled by other means, and that this description is merely an exemplary method of assembling the shaft arrangement. With reference to FIG. 3, the shaft seal 153 can be fitted over the proximal end of the gear adapter 70. An inner mandrel and/or an outer support structure may be used to facilitate placement of the components. The bearing assembly may be placed in an abutting relationship with the distal side of the gear adapter 70. For example, the inner race 130 of the second bearing assembly 120B may be placed in contact with the distal surface 110 of the gear adapter 70, and the bearing 134 and the outer race 132 may be placed to form a unit as is conventional. The inner race spacer 140 may be placed against the inner race 130 and the outer race spacer 142 may be placed against the outer race 132. The inner race 122 of the first bearing assembly 120A may be placed in contact with the inner race spacer 142, and the bearing 126 and the outer race 124 may be placed to form a unit as is conventional. The result is a first subassembly with a plurality of loose fitted parts. Separately, the cam unit 50 can be fitted over the center shaft 34 to form a second subassembly.

The second subassembly can be inserted through the respective bores of the first assembly such that the central opening 72 of the gear adapter 70 receives the proximal end 50B of the cam unit 50. The proximal end of the bearing assembly is positioned proximally beyond the proximal end of the confronting surface 115 of the cam unit 50 such that the gap 113 is formed between the confronting surface 115 and the distal surface 110. A rotatable member such as a gear can be fitted over the proximal end 111 of the gear adapter 70. The clamping device 155 can be inserted from the proximal end through the bores of the gear, the gear adapter 70, and the cam unit 50 to be securely engaged with the center shaft 34. To this end, the secure engagement can provide a desired clamping axial force and torque between the components. In this assembly, the bearing assemblies need not be press-fitted over the cam unit and are thus loose fitted over the cam unit.

However, the inner races may be press-fitted over the cam unit body by various means. For example, the inner races may be heated for expansion, while the cam unit is cooled for contraction before being inserted within the heated inner races. After the temperatures equalize, the inner races can be fitted tightly over the cam unit with a friction fit. It is recognized that other attachment mechanisms between the bearing assemblies and the cam unit can be under taken for a loose fit or a friction fit.

Figure 5:
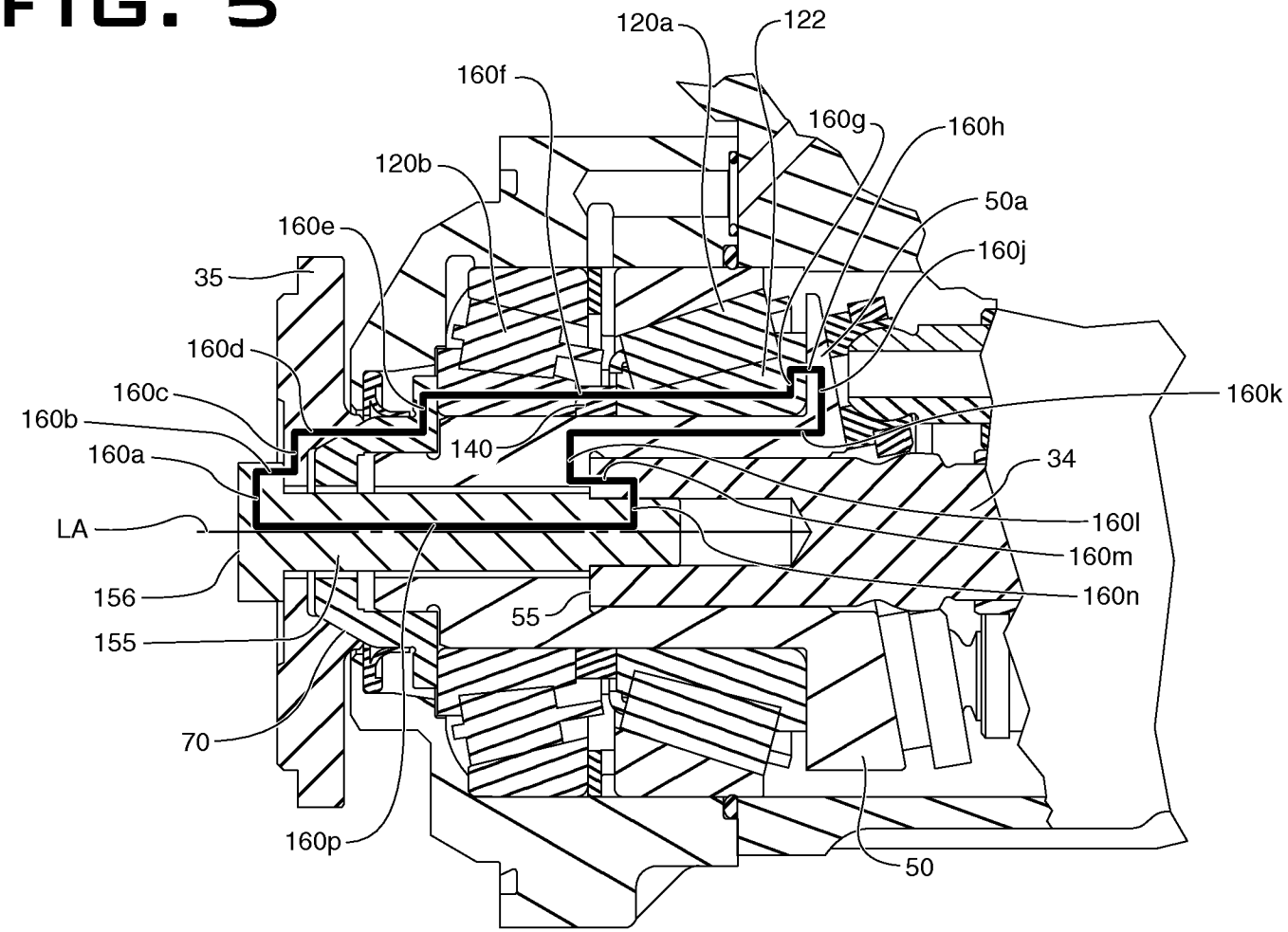
FIG. 5 is an enlarged cross-sectional view of a proximal end of the pump of FIG. 2, depicting the load path through one example of a shaft arrangement.

With reference to FIG. 5, the shaft arrangement permits the formation of a desired load or clamp force path. For example, when the clamping device 155 is securely fixed to the center shaft 34, the first leg 160A of the load path 160 can be directed from the longitudinal axis LA radially outward through the proximal end 156 of the clamping device 155 and the second leg 160B can be directed axially through the proximal end 156 of the clamping device and the gear assembly 35 which are in an abutting relationship. From here, the third leg 160C of the load path 160 can be directed radially outward through the gear assembly 35 and the fourth leg 160D can be directed axially through the gear assembly 35 and the gear adapter 70 which are in a conical interface, rather than directly axially through the proximal end 156 of clamping device 155, the gear assembly 35, and the gear adapter 70. From here, the fifth leg 160E of the load path 160 can be directed radially outward through the gear adapter 70 and the sixth leg 160F can be directed axially through the bearing assemblies 120A, 120B and the inner race spacer 140 which are in an abutting relationship with one another, rather than directly axially through the gear, the gear adapter 70, and the cam unit 50. From here, the seventh leg 160G of the load path 160 can be directed radially outward through the inner race 122 of the first bearing assembly 120A and the eighth leg 160H can be directed axially through the distal end 50A of the cam unit 50 that is in an abutting relationship with the inner race 122. From here, the ninth leg 160J of the load path 160 can be directed radially inward through the distal end 50A of the cam unit 50 and the tenth leg 160K can be directed axially through a partial portion of the cam unit 50 beyond the internal shoulder 55. From here, the eleventh leg 160L of the load path 160 can be directed radially inward within the cam unit 50 and the twelfth leg 160M can be directed axially in the opposite direction through the internal shoulder 55 of the cam unit 50 and the axial end of the center shaft 34 which are in an abutting relationship with one another. From here, the thirteenth leg 160N of the load path 160 can be directed radially inward through the center shaft 34 and the clamping device 155 which are in an abutting relationship with one another. From here, the final leg 160P of the load path 160 can be directed axially through the distal end 158 of the clamping device 155 to the first leg 160A. Torque is also transmitted through the gear adapter 70 via its frictional interface with the gear assembly 35, through the bearing assemblies 120A, 120B via its frictional interface with the gear adapter, through the distal end 50A of the cam unit 50 through its frictional interface with the first bearing assembly 120B, and to the center shaft 34 via the bearing assemblies.

Industrial Applicability

In operation, rotation of the drive shaft of engine 9 causes rotation of the center shaft 34 of the pump 16 via the gear assembly 35. The rotation of the center shaft 34 may act to rotate the cam unit 50 relative to the pistons 60 and the pump housing 30. A biasing force may urge the center shaft 34 against the biasing plate 66 to maintain the shoes 64 and the pistons 60 against the angled camming surface 50. Accordingly, rotation of the camming surface 50 of the cam unit 50 causes pistons 60 to reciprocate in accordance with the axial rise and fall of the angled camming surface 50. During a suction stroke of a piston 60 (associated with movement of the piston from its top-dead-center, distal-most, position to its bottom-dead-center, proximal-most position), low pressure fluid is drawn from the low pressure supply conduit 20 into the housing chamber 30, in through the inlet passage 80, through the shoe bore 84, and into the axial bore 82 of the piston 60 and the pump chamber of the piston. During a discharge stroke of a piston (associated with movement of the piston from its bottom-dead-center, proximal-most, position to its top-dead-center, distal-most, position), the piston 60 is out of alignment with the inlet passage 80 due to rotation of the cam unit 50 so that movement of the piston in a distal direction reduces the size of the pump chamber to pressurize the fluid within the axial bore 82 and the pump chamber of the piston 60. Some of the pressurized fluid is then expelled through the outlet passage (not shown), beyond a check valve (not shown), into the high pressure area 75, into the outlet passage of the pump housing 30, and through the high pressure supply conduit 19 to the common rail 12.

As discussed above, if a desired fluid pressure in the rail is different than the actual pressure in the rail, the amount of high pressure fluid leaving the pump 16 may be varied by the control assembly 17. The control assembly 17 may include the sleeve actuator, a control lever, the idler annulus and the sleeves 90. If the electric control module 15 determines that the pump 16 is supplying excess fluid through the high pressure supply conduit 19 to the common rail 12, a signal may be sent along the communication line 18 to the control assembly 17 to move the respective actuator, control lever, idler annulus, and control sleeves 90 so that the radial spill ports 77 of the piston 60 are uncovered at some point during the piston's discharge stroke. Once the radial spill ports 77 are uncovered, pressurized fluid within the pump chamber and the axial bore 82 of the piston 60 is expelled to the low pressure area 76 of the housing chamber 30, rather than through the outlet passage. Thus, the position of the control sleeve 77 on the piston 60 controls the amount of fluid in the pump chamber that is pressurized and forced through the high pressure outlet passage.

The shaft arrangement described herein can inhibit axial movement of the bearing assembly, such as, e.g., at least two bearing assemblies 120A, 120B, while maintaining a fuseable joint between the rotatable member and the center shaft 34, and a seal between the pump housing 30 and the center shaft 34. For example, the proximal end of the adapter 70 is configured to maintain a frictional interface (e.g., the conical interface) between the center shaft 34 via the cam unit 50 and the rotatable member such as the gear assembly 35 to permit the rotatable member from spinning loose from the center shaft 34 during high torque applications. The distal end of the adapter 70 can be in an abutting relationship with the proximal-most bearing assembly, while leaving a small gap 113 (e.g., about 0.75 mm) between the distal end of the adapter 70 and the center shaft 34 via the cam unit 50. This arrangement directs substantially all of the clamping load axially though the bearing assemblies 120A, 120B, rather than directly through the center shaft 34 via the cam unit 50. The attachment between the clamping device 155 and the center shaft 34 permits a desired clamping force to be transmitted between the rotatable member, the adapter, the bearing assemblies and spacers, the center shaft, and the cam unit, as shown, e.g., in FIG. 5. Torque can be likewise desirably directed between the rotatable member, the adapter, the bearing assemblies and spacer, and the center shaft. The outer surface of the adapter can also provide a sealing surface with the shaft seal. Consequently, the adapter 70 is capable of providing a sealing surface, transmitting a clamping force, transmitting a torque, providing a torque fuse with the gear assembly, or any combination thereof.

The above description is intended for illustrative purposes only, and is not intended to limit the scope of the present invention in any way. For instance, other types of control valves could be substituted for the example illustrated control valve without departing from the intended scope of the present invention. Thus, those skilled in the art will appreciate that various modifications can be made to the illustrated embodiment without departing from the spirit and scope of the present invention, which is defined in terms of the claims set forth below.

What is claimed is:

1. A pump assembly to couple to a rotatable member, comprising:

a pump housing having a housing chamber;

a center shaft extending at least partially through the housing chamber and rotatable about a longitudinal axis;

a plurality of reciprocating pistons disposed within the housing chamber radially about the center shaft;

a cam unit, a central bore extending through the cam unit about the longitudinal axis to receive a portion of the center shaft, a distal end having a camming surface extending radially outward to engage each of the reciprocating pistons, a proximal end opposite the distal end having a shoulder portion;

one or more bearing assemblies disposed along the cam unit between the distal and proximal ends of the cam unit;

an adapter having a central opening extending therethrough about the longitudinal axis to engage the proximal end of the cam unit, a distally facing surface having a radial flange extending radially beyond the shoulder portion of the cam unit to abut the bearing assembly, and an outer radial surface to engage to a rotatable member; and a clamping device insertable through the central opening of the adapter and the central bore of the cam unit to fixedly attach to the center shaft.

2. The pump assembly of claim 1, wherein the proximal end of the cam unit comprises a reduced cross-sectional area for insertion into the central opening of the adapter.

3. The pump assembly of claim 2, wherein the proximal end of the cam unit forms a shoulder portion having a proximally facing surface, wherein the distally facing surface of the adapter and the proximally facing surface are in a confronting relationship and axially spaced from one another to form a gap therebetween.

4. The pump assembly of claim 1, wherein a proximal end of the outer radial surface of the adapter comprises a chamfered surface configured to form a frictional interface with a tapered recess of the rotatable member.

5. The pump assembly of claim 4, wherein the chamfered surface of the adapter extends outwardly beyond the pump housing.

6. The pump assembly of claim 1, further comprising a shaft seal sealably engaged with the outer radial surface of the adapter between the chamfered surface and the radial flange.

7. The pump assembly of claim 1, wherein the clamping device comprises an enlarged first end and an elongated second end extending axially from the enlarged first end about the longitudinal axis.

8. The pump assembly of claim 1, wherein the distal end of the cam unit comprises a proximal surface facing opposite to the camming surface, the one or more bearing assemblies comprises a first bearing assembly and a second bearing assembly captured between the distally facing surface of the adapter and the proximal surface of the distal end of the cam unit.

9. The pump assembly of claim 8, further comprising at least one spacing member disposed between the first bearing assembly and the second bearing assembly.

10. A pump assembly, comprising:

a pump housing having a housing chamber;

a pump drive shaft extending at least partially through the housing chamber and rotatable about a longitudinal axis;

a plurality of reciprocating pistons disposed within the housing chamber radially about the pump drive shaft;

a cam unit having a cam body, a central bore extending through the cam body about the longitudinal axis for receiving a portion of the pump drive shaft, a distal end having an angled camming surface extending radially outward from the cam body for engaging each of the reciprocating pistons, and a proximal end having a shoulder portion;

one or more bearing assemblies disposed along the cam body between the distal and proximal ends of the cam unit;

an adapter having a central opening extending therethrough about the longitudinal axis coupled to the proximal end of the cam unit, a distally facing surface having a radial flange extending radially beyond the shoulder portion of the cam unit abutting the bearing assembly and spaced from a proximally facing surface of the shoulder portion of the cam unit, and an outer radial surface to engage a rotatable member; and a clamping device inserted through the central opening of the adapter and the central bore of the cam unit to fixedly attach to the pump drive shaft.

11. The pump assembly of claim 10, wherein a proximal end of the outer radial surface of the adapter comprises a chamfered surface frictionally engaged with a tapered recess of the rotatable member, wherein the rotatable member is a gear.

12. The pump assembly of claim 10, wherein the clamping device comprises an enlarged first end and an elongated second end extending axially from the enlarged first end about the longitudinal axis, the enlarged first end disposed outside of the rotatable member, the second end inserted through the central opening of the adapter and the central bore of the cam unit to fixedly attach to the pump drive shaft.

13. The pump assembly of claim 10, wherein the distal end of the cam unit comprises a proximal surface facing opposite to the angled camming surface, the one or more bearing assemblies comprises a first bearing assembly and a second bearing assembly captured between the distally facing surface of the adapter and the proximal surface of the distal end of the cam unit.

14. The pump assembly of claim 13, wherein the first bearing assembly and the second bearing assembly are tapered roller bearing assemblies, the first bearing assembly disposed distal to the second bearing assembly and are opposably tapered relative to one another, wherein the first bearing assembly is configured to withstand a greater axial load than the second bearing assembly, and the second bearing assembly is configured to withstand a greater radial load than the first bearing assembly.

15. A method of connecting a rotatable member to a pump assembly, comprising:

coupling an adapter to a rotatable member via a conical friction interface;

coupling a bearing assembly to the adapter such that a distal surface of the adapter is in an abutting relationship with the bearing assembly; and fitting the adapter over a proximal end of a cam unit such that a gap is formed between the distal surface of the adapter, a distal end of the adapter having a radial flange extending radially beyond a shoulder portion of the cam unit and a confronting proximally facing surface of the cam unit, wherein a distal end of the cam unit comprises an angled camming surface in engagement with a plurality of pistons.

16. The method of claim 15, further comprising engaging the cam unit to a pump center shaft of the pump assembly.

17. The method of claim 16, further comprising coupling a clamping device to the center shaft.

18. The method of claim 17, further comprising engaging a proximal end of the center shaft into a counterbore of the cam unit, and attaching a distal end of the clamping device to the proximal end of the center shaft, such that a desired clamp load path is formed by the rotatable member, the adapter, the bearing assembly, the cam unit, the center shaft.

* * * * *